US005560345A

United States Patent [19]

Geyer et al.

[11] Patent Number: 5,560,345

[45] Date of Patent: Oct. 1, 1996

[54] START-ASSIST DEVICE ON A MEMBRANE CARBURETOR

[75] Inventors: Werner Geyer, Waiblingen; Thilo Barth, Abstatt; Peter Stücke, Waiblingen; Horst Eckhardt, Auenwald; Harald Schliemann, Waiblingen; Manfred Rabis, Weinstadt; Jörg Schlossarczyk, Winnenden, all of Germany

[73] Assignee: Andreas Stihl, Waiblingen, Germany

[21] Appl. No.: 418,448

[22] Filed: Apr. 7, 1995

[30] Foreign Application Priority Data

Apr. 16, 1994 [DE] Germany ..... 44 13 270.0

[51] Int. Cl.[6] ..... F02M 1/08; F02M 37/20

[52] U.S. Cl. ..... 123/516; 123/179.16

[58] Field of Search ..... 123/516, 179.16, 123/179.12, 179.14; 261/35, DIG. 68

[56] References Cited

U.S. PATENT DOCUMENTS 3,738,622 6/1973 Tuckey ..... 261/35

4,803,963 2/1989 Kleinhans ..... 123/179.12

4,824,613 4/1989 Scott et al. ..... 261/35

4,905,641 3/1990 Miller ..... 123/516

FOREIGN PATENT DOCUMENTS 3112229 2/1982 Germany .

*Primary Examiner*—Andrew M. Dolinar

*Attorney, Agent, or Firm*—Walter Ottesen

[57] ABSTRACT

The invention is directed to a start-assist device on a membrane carburetor of an internal combustion engine in a motor-driven chain saw which is to be started manually. The carburetor includes a control chamber delimited by a control membrane. The control chamber is supplied with fuel from a fuel tank via control valve. The control valve is opened by the control membrane when the underpressure builds up in the control chamber so that fuel flows in. This fuel is supplied to the air-inducting intake channel via an idle nozzle and a main nozzle. The fuel feed system further has an outlet for vapor bubbles or the like. A pump which is driven indirectly from the start operation is provided and has a suction connection connected to the outlet in order to ensure, with few start attempts, a reliable start of the engine independently of the temperature state of the engine and other influences.

3 Claims, 4 Drawing Sheets

START-ASSIST DEVICE ON A MEMBRANE CARBURETOR

BACKGROUND OF THE INVENTION

Published German patent application 3,112,229 discloses a start-assist device on a membrane carburetor. Vapor bubbles form in the carburetor when an engine is at standstill. The start-assist device disclosed in this publication is intended to prevent such vapor bubbles from hindering a start-up of the engine in a next start attempt. The membrane carburetor includes an intake channel and a throttle flap disposed in the intake channel as well as a control chamber which is delimited by the membrane and filled with fuel. The metering of fuel into the control chamber is controlled by means of a control valve. The fuel reaches the nozzles from the control chamber and enters the intake channel via the nozzles. A pneumatic actuating element is furthermore provided and has a work chamber which can be charged with the pressure or underpressure in the intake pipe of the engine. The movable partition wall delimits the work chamber and is operatively connected to a valve in the other chamber. This valve is closed when there is an underpressure in the intake pipe. A connecting channel is provided between the control chamber and the additional chamber of the pneumatic actuating element. Via this connecting channel, vapor bubbles or air in the fuel system can flow away when the engine is at standstill.

SUMMARY OF THE INVENTION

It is an object of the invention to improve a carburetor of the kind described above so that a reliable start of the engine is provided with few start attempts independently of the temperature state of the engine and other influences.

The invention is for a combination of a start-assist device and membrane carburetor arrangement for an internal combustion engine. The combination includes: a manual-start engine of a portable handheld work apparatus such as a motor-driven chain saw, a cutoff machine or the like, the combination comprising: the membrane carburetor including a carburetor housing; the carburetor housing defining an air-intake channel communicating with the engine and through which a stream of air is drawn by suction when the engine is operating; the air-intake channel including a venturi section; the carburetor housing further defining an interior space; a control membrane mounted in the interior space so as to define a control chamber therein bounded by the membrane; a fuel-feed system including: the control chamber; a fuel tank; fuel conveying means for moving the fuel from the fuel tank into the control chamber; and, control valve means for metering the fuel into the control chamber; the control valve means being operatively connected to the control membrane to open and close when an underpressure develops in the control chamber thereby metering the fuel into the control chamber; nozzle means communicating with the control chamber for passing the fuel into the venturi section of the air-intake channel; and, the start-assist device including: outlet means for communicating with the fuel-feed system; pump means connected to the outlet means for drawing fluid from the fuel-feed system at a pregiven state of the engine; and, drive means for driving the pump means.

The pump driven by the engine or by the start operation pumps away vapor bubbles, air, fuel/air mixture and, if required, fuel itself independently of external conditions. In this way, a flooding of the fuel system is assured so that the next start attempts can take place with a filled fuel system.

This ensures a rapid start of the engine with few start attempts.

The pressure connection of the pump to the fuel system is preferred so that pumped recirculation takes place in a closed circuit. The pressure connection of the pump is preferably to the fuel tank. A recirculation of this kind also ensures that adhering vapor bubbles in crevices or the like are entrained and pumped away. The following can be utilized as a venting pump: piston pump, membrane pump, bellows pump or the like.

In a preferred embodiment, the engine is mounted in a housing via anti-vibration elements. The pump comprises two pump parts which move back and forth relative to each other and the first pump part is fixedly mounted to the engine and the second pump part is fixedly mounted to the housing. The pump is preferably mounted between the handle housing and the engine and preferably in a vibration gap between the handle housing and the engine. The relative movements of the housing parts in the vibration gap caused by the start attempt effect a relative movement of the pump parts with respect to each other so that a pumping action is provided by means of which vapor bubbles are pumped away. Such a pump is simple and requires no adjustments by the operator. The pump ensures a reliable pumping away of vapor bubbles also when the internal combustion engine is running.

In a further embodiment of the invention, the pump is driven by a pressure source such as the crankcase pressure of the engine. In this way, a venting pump is likewise provided which operates without intervention by the operator and which ensures a start of the engine with few start attempts.

In another embodiment of the invention, the pump is a cam pump which can be actuated by a cam rotating with the rope drum of a pull-rope starter. Such a mechanical type of drive affords the advantage that the pump is actuated by a start attempt as well as with a re-rolling of the rope on the rope drum, that is, when preparing for a next start attempt. This type of drive optimally utilizes the rotation movements necessary for a pull-rope starter.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
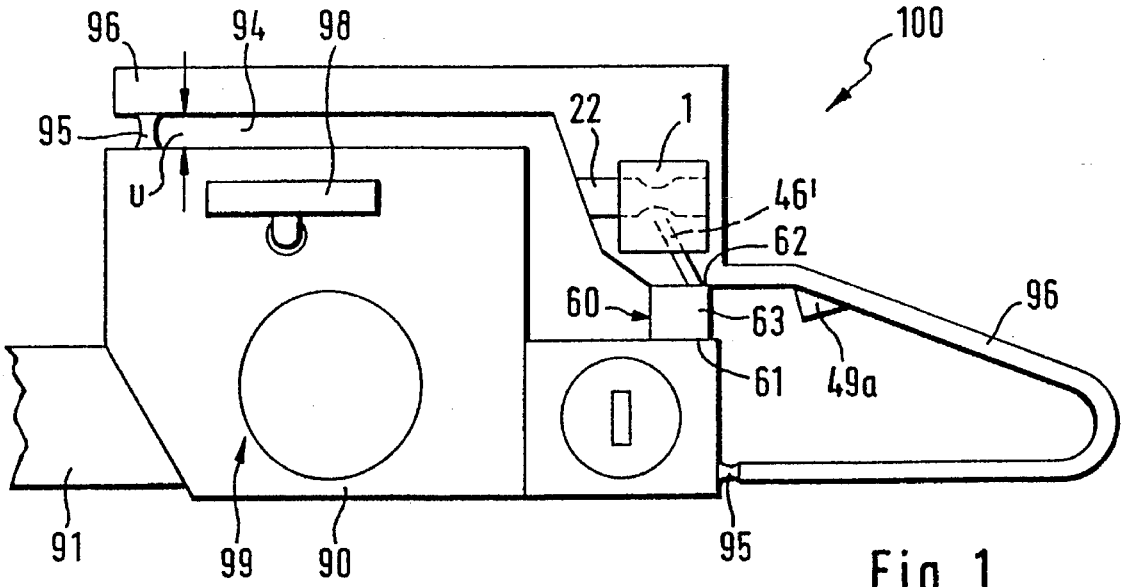
FIG. 1 is a schematic representation of a portable handheld work apparatus equipped with a start-assist device according to the invention.
Figure 2:
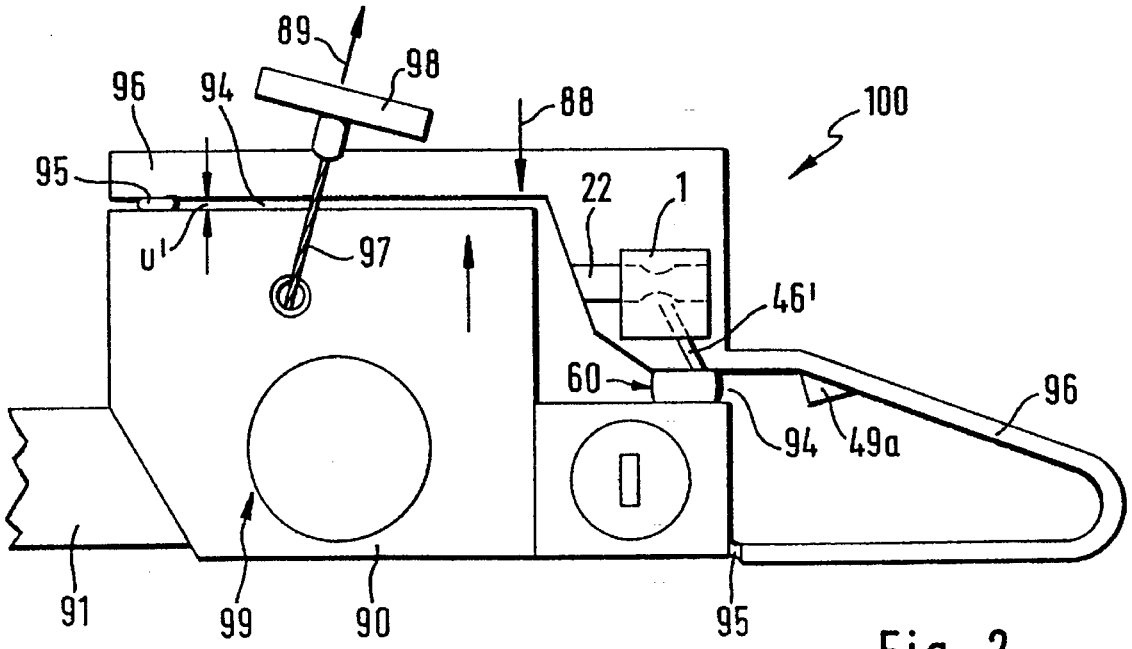
FIG. 2 is a schematic representation of the work apparatus of FIG. 1 during a start attempt.

The work apparatus shown schematically in FIGS. 1 and 2 is a motor-driven chain saw 100 which essentially includes an internal combustion engine mounted in a motor housing 90. The engine is mostly a single-cylinder two-stroke engine and drives a saw chain moving on a guide bar 91. The engine is securely attached to the motor housing 90 and is mounted within a handle housing 96 by means of anti-vibration elements 95 so that an operator guiding the chain saw is essentially isolated from the engine vibrations. A gap 94 is provided in order to permit the required relative movement between the engine block and the handle housing. The gap 94 is bridged by the anti-vibration elements 95. The gap 94 is also referred to as a vibration gap. A pull-rope starter 99 is disposed in housing 90 and is mounted on the longitudinal side of the motor-driven chain saw 100. The pull-rope starter 99 is provided for starting the internal combustion engine. For this purpose, a handle 98 is attached to a pull rope 97 and is pulled in the direction of arrow 89. For this reason, the vibration gap 94 becomes narrower because the operator applies a counter force to the handle housing 96 which acts in the direction of arrow 88. For an engine at standstill and for a handle housing to which no load is applied, the vibration gap 94 has a width (u) which is reduced to the value (u') because of a pull force in the direction of arrow 89 during a start attempt.

According to the invention, a bellows pump 60 is mounted in the vibration gap 94. The pump has first and second parts (61, 62) and the first pump part 61 is fixedly connected to the engine and the second pump part 62 is fixedly attached to the handle housing. In this way, the bellows 63 bridges the vibration gap 94 and therefore is subjected to changes in magnitudes of the gap. Accordingly, the volume of the bellows 63 will increase and decrease in correspondence to the width of the vibration gap.

Figure 3:
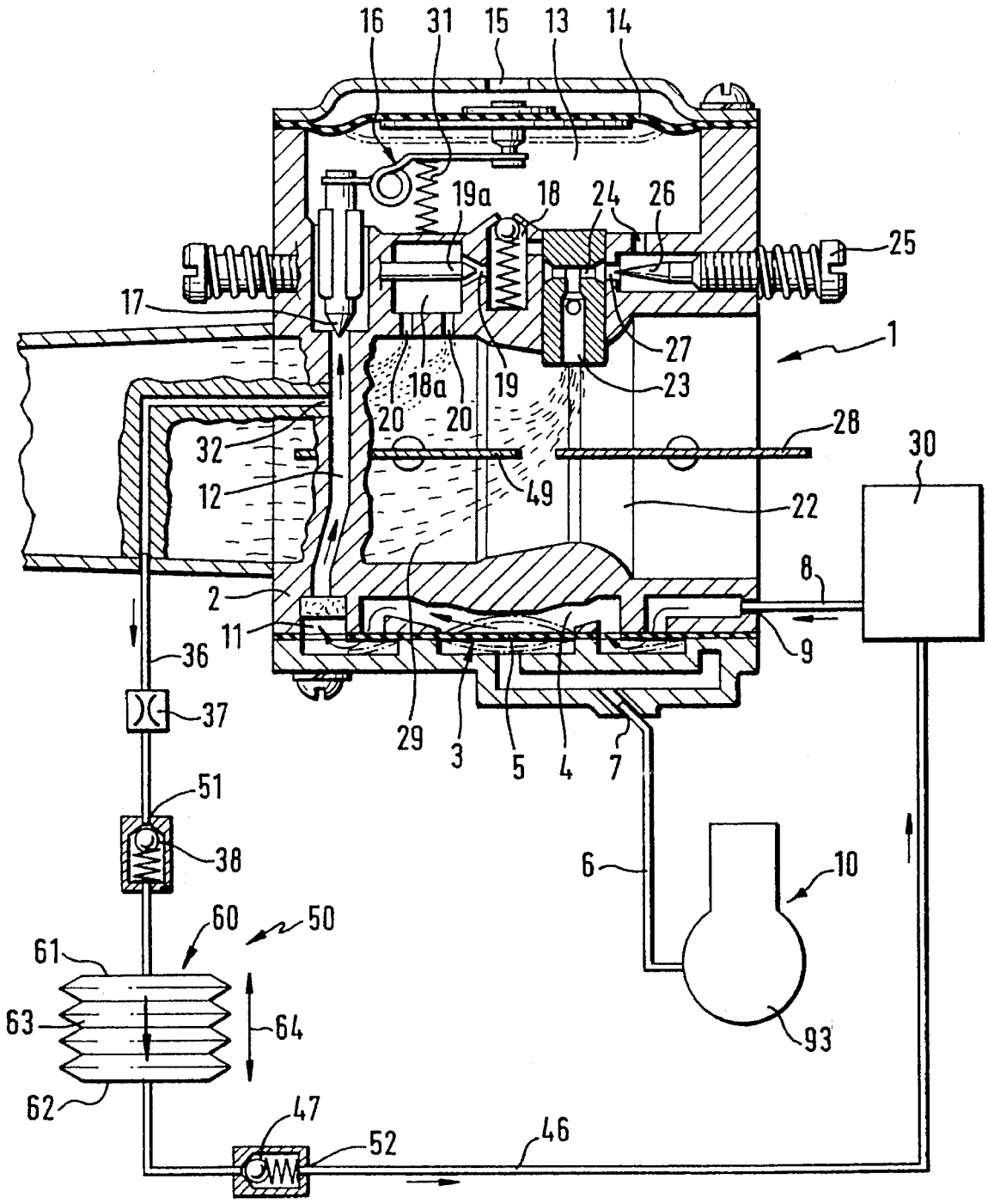
FIG. 3 is a schematic of a membrane carburetor, in section, equipped with a start-assist device.

As shown in FIG. 3, the pump parts 61 and 62 move back and forth relative to each other in the direction of the double arrow 64 thereby causing the bellows 63 to execute a pump movement. The bellows 63 is connected to a check valve 38 on the side of the pump part 61 attached to the housing. The check valve opens into the bellows 63. In this way, a suction connection 51 is formed which communicates with a connection 32 via a throttle 37 and a suction line 36. The connection 32 branches off from a fuel channel 12 of a fuel feed pump 3 in the membrane carburetor. The fuel channel 12 leads to a control valve 17.

A check valve 47 is mounted on the side of the pump part 62 whereby a pressure connection 52 is formed. A pressure line 46 leading to a fuel tank 30 is connected to the pressure connection 52. The suction connection 9 of the fuel feed pump 3 is supplied from the fuel tank 30 via a fuel line 8. The fuel feed pump 3 includes a pump chamber 4 delimited by a pump membrane 5 made of rubber. The pump chamber 4 communicates with the suction connection 9 via a correspondingly configured first check valve and with a filter chamber 11 via a correspondingly configured second check valve. The dry side of the pump membrane 5 is charged with changing pressure in the crankcase 93 of the engine 10. This crankcase pressure is supplied to the work chamber of the fuel feed pump 3 via a pulse line 6 and a pulse connection 7. The pump chamber 4 is arranged in the carburetor housing 2.

A fuel channel 12 leads from the filter chamber 11 into a control chamber 13 arranged in the carburetor housing 2. A control membrane 14 is mounted in the control chamber 13 and, on the one hand, delimits the control chamber 13 and, on the other hand, is charged with ambient pressure (atmospheric pressure) via a vent opening 15 in a housing cover. The control membrane 14 acts via an angle lever 16 on a control valve 17 so that the control valve 17 opens when there is an increasing underpressure in the control chamber 13 and so that a pressure-compensating supply of fuel is ensured. The control spring 31 is provided for returning the control membrane 14 and the control valve 17.

The fuel flows from the control chamber 13 via a main fuel passthrough 18 and a valve opening 19 into an idle chamber **18*a*. The idle chamber 18*a* opens via idle fuel nozzles 20 into the venturi section 29 of an intake channel 22. The idle fuel nozzles 20 open in the pivot region of a throttle flap 49 mounted in the venturi channel 29. The valve opening 19 can be adjusted by a valve needle 19*a* by screwing the valve needle in or out. A main fuel nozzle 23 opens into the intake channel 22 upstream of the throttle flap 49. The main fuel nozzle 23 is connected to the control chamber 13 via fuel throughpass 24 and a valve opening 27. The valve opening 27 can be adjusted via the valve cone 26 of a main nozzle screw 25**.

The throttle flap 49 is actuated by means of a throttle lever **49*a* (see FIG. 2). A choke flap 28 is mounted ahead of the throttle flap 49 and is pivoted into a start position for starting the engine. In the start position, the choke flap 28 partially closes off the intake channel 22**.

If the pull-rope starter 99 is actuated to start the engine, then the vibration gap 94 becomes narrower so that the pump parts (61, 62) are moved toward each other. After passing through top dead center with the first pull during a start attempt, the pull force goes to zero so that the vibration gap 94 returns to the start width (u) whereby the pump parts (61, 62) move away from each other. An underpressure develops in the bellows 63 so that fuel, air or an air/fuel mixture is drawn by suction from the fuel channel 12 through the check valve 47. The pump action of the bellows pump 60 is then so great that, even with the formation of vapor bubbles in the fuel feed pump 3 or a no-load operation of this pump, the fuel feed pump 3 is flooded with fuel after three to five rotations of the crankshaft per pull-rope start so that fuel can flow to the control chamber 13 and a direct start of the engine is ensured. The fuel drawn off via the suction line 36 is conducted back to the fuel tank 30 via the pressure line 46 so that a closed circuit is established. The bellows pump 60 can pump fuel also when the engine is running because of the movements of the pump parts (61, 62) which occur in the vibration gap 94. For this reason, fuel is pumped from the fuel channel 12 into fuel tank 30 even when the engine is running whereby the formation of vapor bubbles, which can possibly form during operation of the engine, does not affect the metering of fuel to the engine.

The throttle 37 is mounted in the suction line in order to ensure that mostly air or vapor bubbles are pumped by the bellows pump 60. The throttle action of the throttle 37 is greatly increased when there is a wetting with the fuel. In this way, preferably gaseous substances can easily pass the throttle. It is therefore assured that even for a running engine, essentially air or vapor bubbles are pumped by the bellows pump 60 and the pumping capacity of the fuel feed pump 3 is not affected. It is here emphasized that the bellows pump 60, which is provided as a start-assist device 50, operates without being manually actuated (that is, without an adjustment by the operator) so that the start operation of the engine is facilitated without intervention and, even for an engine which is running, vapor or air bubbles which can possibly form are drawn away before entry into the control chamber. For this reason, the connection 32 for the suction line 36 is provided upstream of the control valve 17 in the vicinity of the latter.

The pressure line 46' of the bellows pump 60 can advantageously also open into the venturi section 29 of the intake channel 22 as shown in FIGS. 1 and 2.

Figure 4:
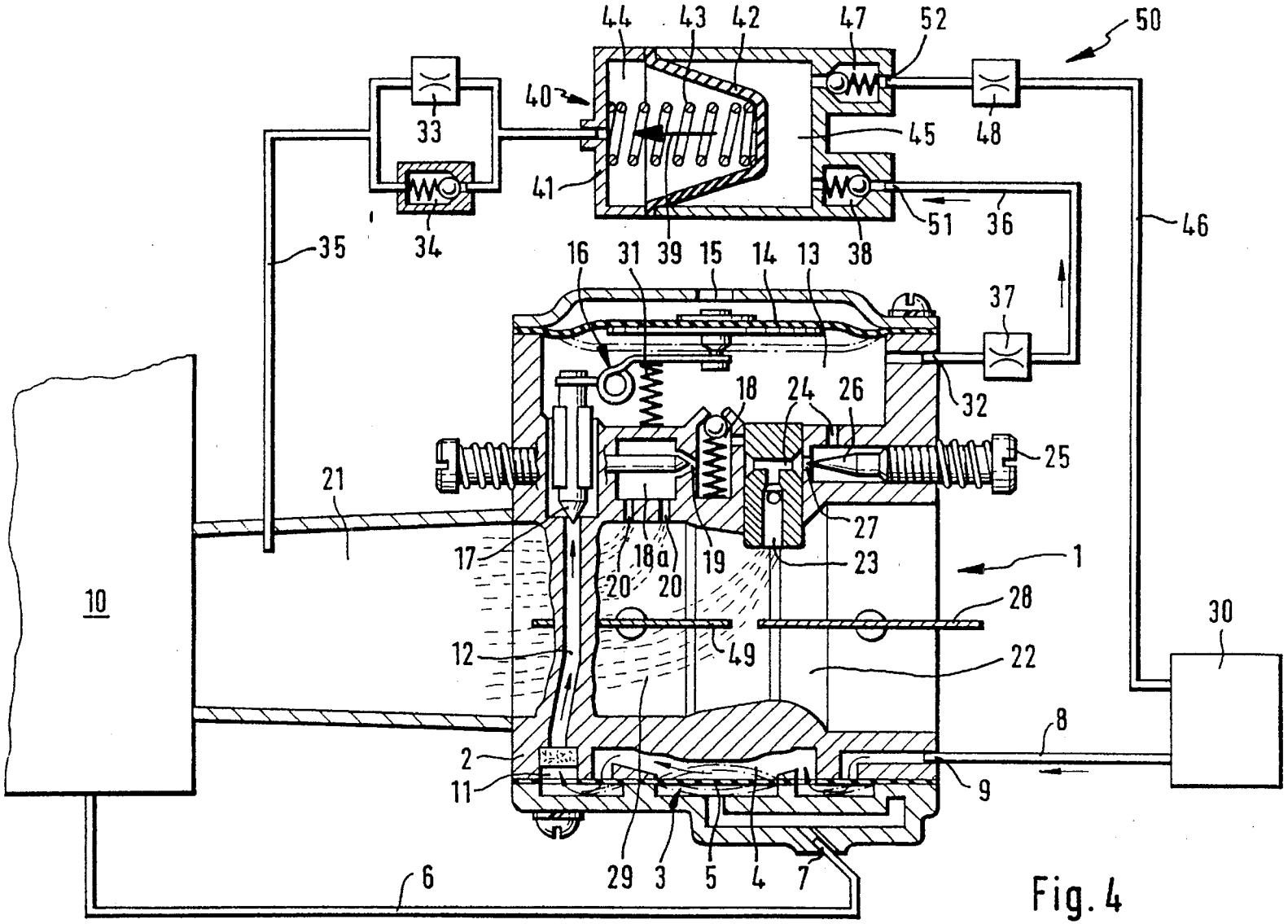
FIG. 4 is a section view taken through a membrane carburetor equipped with another embodiment of a start-assist device.

A further embodiment of a start-assist device is shown in FIG. 4. The membrane carburetor shown in FIG. 4 corresponds in configuration to that shown in FIG. 3. For this reason, the same parts are indicated with like reference numerals.

In the embodiment of FIG. 4, a membrane pump 40 is provided as a venting pump and is mounted in a housing 41. The housing 41 is partitioned by a flexible partition wall 42 in the form of a rubber membrane and subdivides the housing 41 into a work chamber 44 and a suction chamber 45. The suction chamber 45 provides a suction connection 51 by means of a check valve 38. The suction connection 51 is connected via the suction line 36 and a throttle 37 to a connection 32 which leads directly away from the control chamber 13. The check valve 47 defines a pressure connection 52 and the suction chamber 45 is connected via the check valve 47 and a pressure line 46 to the fuel tank. A throttle 48 is preferably provided in the pressure line 46.

The work chamber 44 of the membrane pump 40 is connected via a check valve 34 and a connecting line 35 to an intake channel section 21. The check valve 34 opens in flow direction toward the intake channel section 21. A compensating throttle 33 is connected in parallel to the check valve 34.

When the engine is started, the throttle flap 49 as well as the choke flap 28 are in the start position in which they close the intake channel 22 over the greatest part of the cross section thereof. In this way, a high underpressure develops in the intake channel section 21 which is present via the connecting line 35 and the opening check valve 34 in the work chamber 44. This underpressure in the work chamber 44 causes the membrane wall 42 to be displaced against the force of the return spring 43 in the direction of arrow 39 thereby considerably increasing the volume of the suction chamber 45. The increase in volume causes an underpressure to develop in the suction chamber 45 and this underpressure draws off the fluid (fuel, vapor bubbles, air/fuel mixture and the like) located in the control chamber 13. The fluid is drawn off via the connection 32, the throttle 37, the suction line 36 and the check valve 38 so that the control chamber 13 is flooded via the control valve 17 with liquid fuel. In this way, it is ensured that the control chamber 13 is filled with fuel during the start operation and that sufficient fuel can exit via the idle nozzles 20 to start the engine.

The underpressure in the intake channel section can drop and this occurs especially at standstill of the engine. If this underpressure becomes zero, then a pressure equalization takes place in the work chamber 44 via the compensating throttle 33. The return spring 43 displaces the rubber membrane 42 opposite to the direction of arrow 39 and into the base position shown in the drawing. The fluid disposed in the suction chamber 45 is returned to the fuel tank 30 via the check valve 47 of the pressure connection 52 and the pressure line 46. The throttles 37 and 48 in the suction line 36 and the pressure line 46, respectively, are provided to prevent a rapid change of pressure.

In order to ensure an adequate flooding of the control chamber during the start operation of the engine, the suction chamber 45 is provided in such a manner that the increase in volume thereof corresponds to the volume of all chambers and supply lines between the suction connection and the fuel tank.

Figure 5:
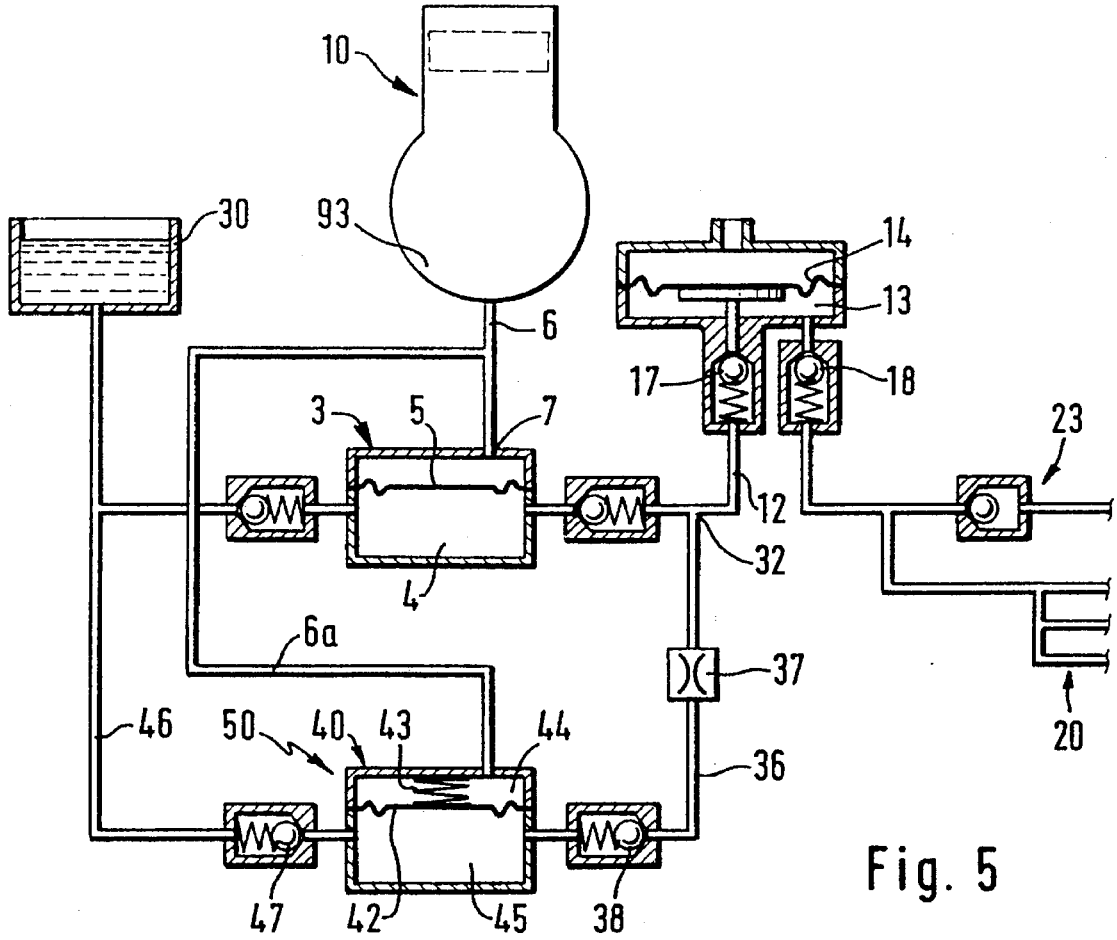
FIG. 5 is a schematic representation of a further embodiment of a start-assist device; and, FIG. 6 is a mechanically driven start-assist device according to still another embodiment of the invention.

In the embodiment of FIG. 5, a start-assist device 50 is shown which is configured in a manner corresponding to the embodiment shown in FIG. 4. Accordingly, the same parts are identified by like reference numerals.

As a departure from the embodiment of FIG. 4, the embodiment of FIG. 5 includes a connection 32 between the pressure valve of the fuel pump 3 and the control valve 17. The connection 32 branches off from the connecting fuel channel 12. Furthermore, the work chamber 44 of the membrane pump 40 is connected via a pulse line **6*a* to the crankcase 93 of the engine 10 so that the membrane pump 40 is not only driven by the changing crankcase pressure during the start operation but also pumps during the operation of the machine. A throttle 37 is provided in the suction line 36 in order to ensure that no loss in power of the fuel feed pump takes place. The throttle 37** substantially precludes a passage of fuel and only allows air or an air/fuel mixture to pass.

Figure 6:
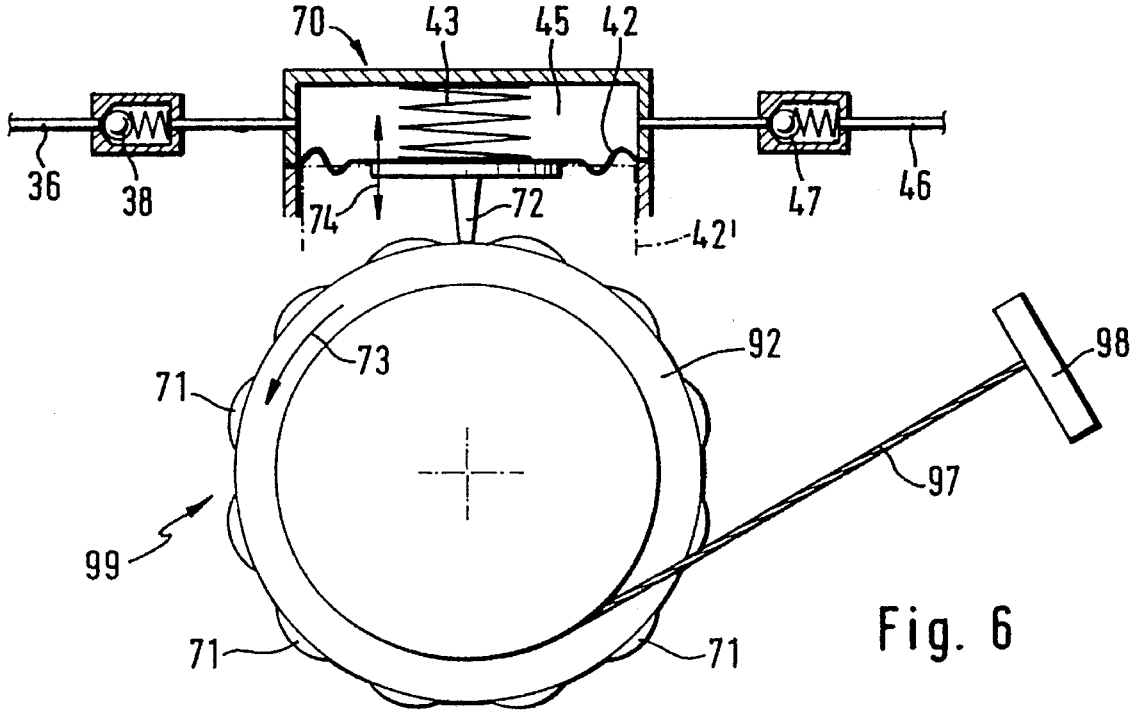

In the embodiment of FIG. 6, the suction chamber 45 is again delimited by a membrane 42. In lieu of the membrane, a piston 42' could also be provided as shown in phantom outline in FIG. 6. The membrane 42 or the piston 42' is subjected to force by a spring 43 in the sense of enlarging the suction chamber 45. The suction chamber 45 is furthermore connected to a suction line 36 via a check valve 38 which opens toward the suction chamber 45 and is connected to a pressure line 46 via the check valve 47. The spring 43 holds a push rod 72 against the outer periphery of a rope drum 92 of the pull-rope starter 99. Cams 71 are provided on the outer surface of the rope drum 92 as shown. The cams 71 are preferably mounted over the periphery of the rope drum 92 at equidistant spacings. Preferably, one to four cams are provided. Twelve cams 71 are provided in the embodiment of FIG. 6.

When the pull rope 97 is pulled, the rope drum 92 rotates in the direction of arrow 73 so that the membrane 42 is moved back and forth in the direction of double arrow 74. The pump action is generated by this reduction and enlargement of the suction chamber 45 so that a pumping from the suction line 36 to the pressure line 46 is provided. It is advantageous that a cam pump, which is driven by the pull-rope starter 99, is actuated not only during the start attempt itself but also that a pump stroke takes place when the pull rope 97 is rolled up after a start attempt or directly in advance of the first engine revolution. In this way, the number of necessary attempts until the engine starts up is further reduced.

It is understood that the foregoing description is that of the preferred embodiments of the invention and that various changes and modifications may be made thereto without departing from the spirit and scope of the invention as defined in the appended claims.

What is claimed is:

1. The combination of a start-assist device and membrane carburetor arrangement for an internal combustion engine including a manual-start engine of a portable handheld work apparatus, said work apparatus including a housing and antivibration elements for mounting said engine in said housing whereby relative movement occurs between said engine and said housing; the combination comprising:

said membrane carburetor including a carburetor housing;

said carburetor housing defining an air-intake channel communicating with the engine and through which a stream of air is drawn by suction when the engine is operating;

said air-intake channel including a venturi section;

said carburetor housing further defining an interior space;

a control membrane mounted in said interior space so as to define a control chamber therein bounded by said membrane;

a fuel-feed system including: said control chamber; a fuel tank; fuel conveying means for moving said fuel from said fuel tank into said control chamber; and, control valve means for metering said fuel into said control chamber;

said control valve means being operatively connected to said control membrane to open and close when an underpressure develops in said control chamber thereby metering said fuel into said control chamber;

nozzle means communicating with said control chamber for passing said fuel into said venturi section of said air-intake channel;

said start-assist device including: outlet means for communicating with said fuel-feed system;

pump means connected to said outlet means for drawing fluid from said fuel-feed system at a pregiven state of said engine; and, drive means for driving said pump means;

said pump means having an intake connection and a pressure connection;

said intake connection being connected to said outlet means;

said pump means being a pump having first and second pump parts movable relative to each other; and, said first pump part being fixedly connected to said engine and said second pump part being fixedly connected to said housing whereby said engine and said housing conjointly define said drive means.

2. The combination of claim 1, wherein said work apparatus includes a handle housing and said engine is disposed within said handle housing; said engine and said handle housing conjointly defining a vibration gap therebetween to allow said engine and said handle housing to move relative to each other; and, said pump being mounted in said gap.

3. The combination of claim 2, wherein said work apparatus includes a pull-rope starter fixed to said engine which causes said gap to become narrower when pulling on the pull-rope starter while holding the handle housing.

* * * * *